US010845154B2

(12) United States Patent
Griggs et al.

(10) Patent No.: US 10,845,154 B2
(45) Date of Patent: Nov. 24, 2020

(54) ARCHERY RELEASE DEVICE

(71) Applicant: Scott Archery, LLC, Stanton, KY (US)

(72) Inventors: Eric J. Griggs, Stanton, KY (US); Derek A. Woods, Berea, KY (US); Todd D. Cook, Cecilia, KY (US); Lance M. Horn, Irvine, KY (US)

(73) Assignee: TOG-IP LLC, West Henrietta, NY (US)

( * ) Notice: Subject to any disclaimer, the term of this patent is extended or adjusted under 35 U.S.C. 154(b) by 0 days.

(21) Appl. No.: 15/841,859

(22) Filed: Dec. 14, 2017

(65) Prior Publication Data

US 2018/0172390 A1 Jun. 21, 2018

Related U.S. Application Data

(60) Provisional application No. 62/435,198, filed on Dec. 16, 2016.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS 4,407,260 A * 10/1983 Lyons ..... F41B 5/1469 124/35.2
5,170,771 A * 12/1992 Peck ..... F41B 5/1469 124/35.2
5,307,788 A * 5/1994 Peck ..... F41B 5/1469 124/35.2
5,318,004 A * 6/1994 Peck ..... F41B 5/1469 124/35.2
5,357,939 A * 10/1994 Tentler ..... F41B 5/1469 124/35.2
5,370,102 A * 12/1994 Peck ..... F41B 5/1469 124/35.2
5,448,983 A * 9/1995 Scott ..... F41B 5/1469 124/35.2
5,546,924 A * 8/1996 Todd ..... F41B 5/1469 124/31
5,558,077 A * 9/1996 Linsmeyer ..... F41B 5/1469 124/35.2
5,595,167 A * 1/1997 Scott ..... F41B 5/1469 124/1
5,765,536 A 6/1998 Scott
5,850,825 A 12/1998 Scott
5,941,225 A * 8/1999 Tentler ..... F41B 5/1469 124/35.2
6,484,710 B1 * 11/2002 Summers ..... F41B 5/1469 124/35.2

(Continued)

*Primary Examiner* — Alexander R Niconovich
(74) *Attorney, Agent, or Firm* — Barclay Damon LLP

(57) ABSTRACT

An archery release device and method are disclosed therein. The archery release device includes, in an embodiment, a release body, and first and second jaws independently pivotally mounted to the release body. The archery release device also has a trigger mounted to the release body and an actuation step operative to hold the first and second jaws in a closed position during targeting and in an open position for release of an arrow from an archery bow.

22 Claims, 10 Drawing Sheets

(56) References Cited

U.S. PATENT DOCUMENTS

| | | | | |
|---|---|---|---|---|
| 6,763,819 | B2 * | 7/2004 | Eckert | F41B 5/1469 124/35.2 |
| 6,925,995 | B1 * | 8/2005 | McConnell | F41B 5/1469 124/35.2 |
| 7,240,672 | B2 * | 7/2007 | Peck | F41A 19/16 124/35.2 |
| 7,278,415 | B2 | 10/2007 | Jones | |
| 7,314,045 | B2 * | 1/2008 | Eckert | F41B 5/1469 124/35.2 |
| 7,946,282 | B2 * | 5/2011 | Jones | F41B 5/1469 124/35.2 |
| 8,146,578 | B2 * | 4/2012 | Jones | F41B 5/1469 124/35.2 |
| 8,276,575 | B1 * | 10/2012 | Gillig | F41B 5/1469 124/31 |
| D688,346 | S | 8/2013 | Jones | |
| 8,522,764 | B1 * | 9/2013 | LoRocco | F41B 5/1469 124/35.2 |
| 8,522,765 | B1 * | 9/2013 | LoRocco | F41B 5/1469 124/35.2 |
| D697,575 | S | 1/2014 | Jones | |
| D697,992 | S | 1/2014 | Jones | |
| 8,746,222 | B2 * | 6/2014 | Jones | F41B 5/1469 124/35.2 |
| 8,746,223 | B2 | 6/2014 | Jones | |
| 8,869,781 | B2 | 10/2014 | Jones | |
| 9,163,897 | B1 * | 10/2015 | Estridge | F41B 5/1469 |
| 9,395,144 | B1 * | 7/2016 | LoRocco | F41B 5/1469 |
| 9,857,139 | B2 | 1/2018 | Kelly et al. | |
| 9,863,736 | B2 | 1/2018 | Kelly et al. | |
| 9,891,019 | B2 | 2/2018 | Haas et al. | |
| 2003/0230295 | A1 | 12/2003 | Jones | |
| 2013/0174821 | A1 * | 7/2013 | Jones | F41B 5/1469 124/35.2 |
| 2018/0010888 | A1 | 1/2018 | Finley | |

* cited by examiner

ARCHERY RELEASE DEVICE

CROSS-REFERENCE TO RELATED APPLICATION

This application is a non-provisional of, and claims the benefit and priority of, U.S. Provisional Patent Application No. 62/435,198 filed on Dec. 16, 2016. The entire contents of such application are hereby incorporated by reference.

BACKGROUND

Most popular sports, especially those enjoyed by a more avid or puritanical group of enthusiasts, offer a variety of accessories which make participation in the activity more enjoyable and/or more proficient. Bow hunting may be viewed as one such activity which requires a much higher/greater degree of skill and proficiency, than, perhaps, a hunter who employs a common firearm or rifle. To prevent an archer employing a bow/arrow from taking an errant shot on target, it is common to employ one of a variety of targeting and/or release devices which allow the bow hunter to quietly aim and deliver an arrow with a relatively high degree of accuracy, whether aiming at a target or animal.

Archery is impacted by even the smallest of variations at the time of release. Even small motions can affect the aim and trajectory of the arrow, including inhalation/exhalation, a shaking hand, and/or unintentional twitch of a finger or jerk of an arm. That is, angular deviations exacerbate long-range shots inasmuch as the effects of lateral deviation increase dramatically as the longitudinal distance increases. It is for this reason, that a long-range shooter either stops breathing or exhales upon release.

The archery enthusiast is also given a variety of targeting release aids for improving the accuracy of an arrow's trajectory. FIGS. 1*a* and 1*b* depict a prior art release aid 100 which employs a strap 102 to connect the release mechanism 100 to an archer's wrist or arm. The release aid 100 employs a single jaw 104 which pivots toward, and against, a cinch or stop 106 to capture/engage a loop formed in combination with the drawstring 110 of the bow 120. An example of a single jaw release mechanism is shown in Jones U.S. Pat. No. 8,146,578. One of the principle disadvantages of such a release aid 100 relates to its inability to accommodate an archer's lateral motion at the moment immediately prior to release of the drawstring 110. As shown in FIG. 1*b*, if an archer jerks his/her hand slightly in a lateral outward direction LD1, the static stop 106 will move the drawstring 110 in the same direction LD1. The laterally displaced drawstring 110 can change the direction of the arrow, resulting in decreased shooting accuracy.

Other release mechanisms, such as those disclosed in Jones U.S. Patent Publication 2013/0174821 and Jones U.S. Pat. No. 8,746,223 include a dual jaw release which open along a central plane. The dual jaw of these "caliper release" mechanisms are symmetric about a central bifurcating plane or open symmetrically relative to the bifurcating plane. While these release mechanisms offer the advantage of a rapid release, they do not allow the drawstring to move freely over the jaws upon release. As such, they too can impart an undesired lateral displacement and adversely impact shooting accuracy.

The foregoing background describes some, but not necessarily all, of the problems, disadvantages and shortcomings related to archery release aids of the prior art.

SUMMARY

An archery release device, in an embodiment, is provided including a release body, first and second jaws pivotally mounting to the release body about respective pivot axes, and a trigger pivotally mounting to the release body and having at least one actuation step configured to: (i) engage an actuation end of at least one of the first and second jaws, and (ii) facilitate independent motion of at least one of the first and second jaws in response to a lateral force applied by the archery bow upon release. The first and second jaws pivot toward each other when engaging a drawstring of an archery bow and pivot away from each other in response to activation by the actuation step to release the drawstring of the archery bow.

A method, in an embodiment, is also provided for manufacturing an archery release device. The method comprises: configuring a release body to include a trigger support and a jaw support; configuring a trigger for mounting to the trigger support and including at least one actuation step on a peripheral surface thereof; configuring a pair of opposing jaws such that each of the opposing jaws pivot about a pivot axis of the jaw support, each of the opposing jaws having a release end and an actuation end; configuring the release ends of the opposing jaws to cooperate and hold a drawstring of the archery bow in a ready position during target acquisition, and configuring at least one of the actuation ends to engage at least one actuation step to: (a) hold the opposing jaws in a closed position during target acquisition, and (b) effect independent motion of the opposing jaws upon actuation of the trigger and release the drawstring of the archery bow.

Additional features and advantages of the present disclosure are described in, and will be apparent from, the following Brief Description of the Drawings and Detailed Description.

DETAILED DESCRIPTION

Figure 1A:
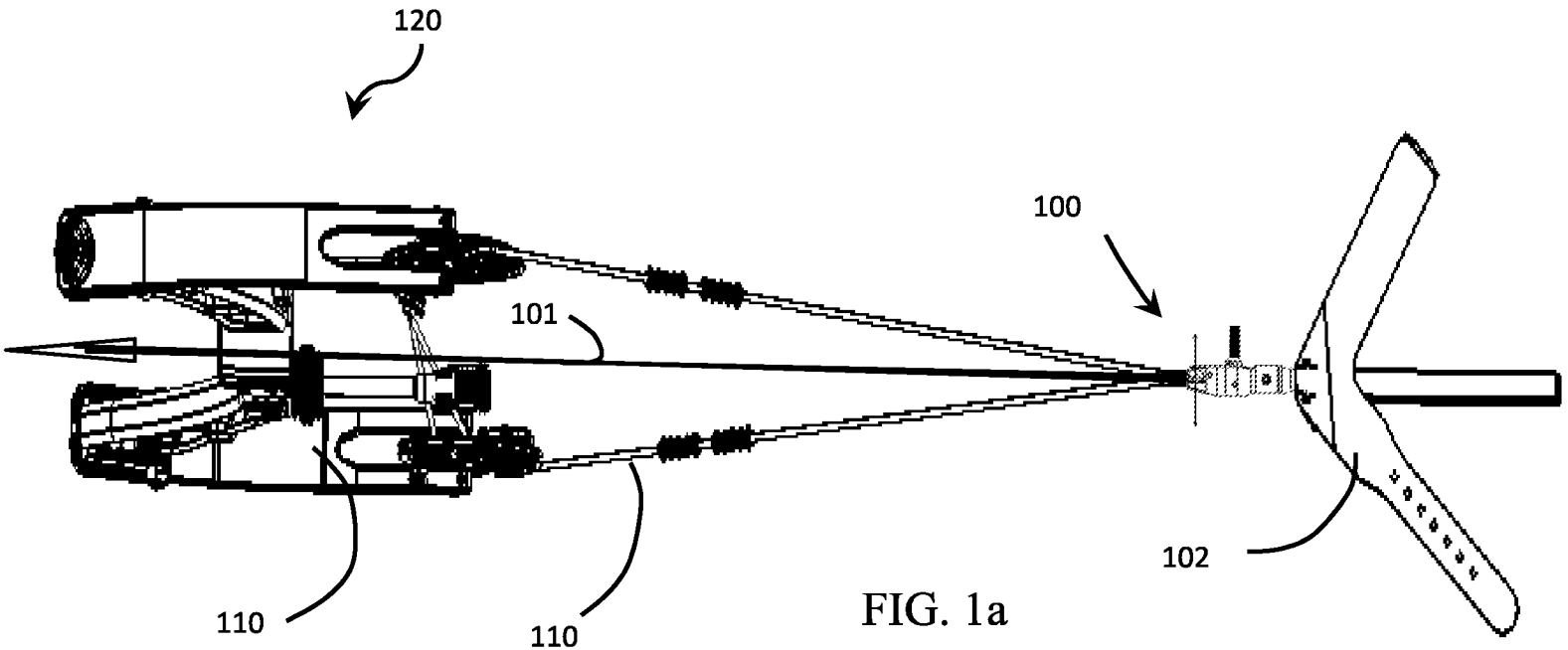
FIG. 1a (PRIOR ART)
FIG. 1*a* is a top perspective view of a prior art release mechanism.
Figure 1B:
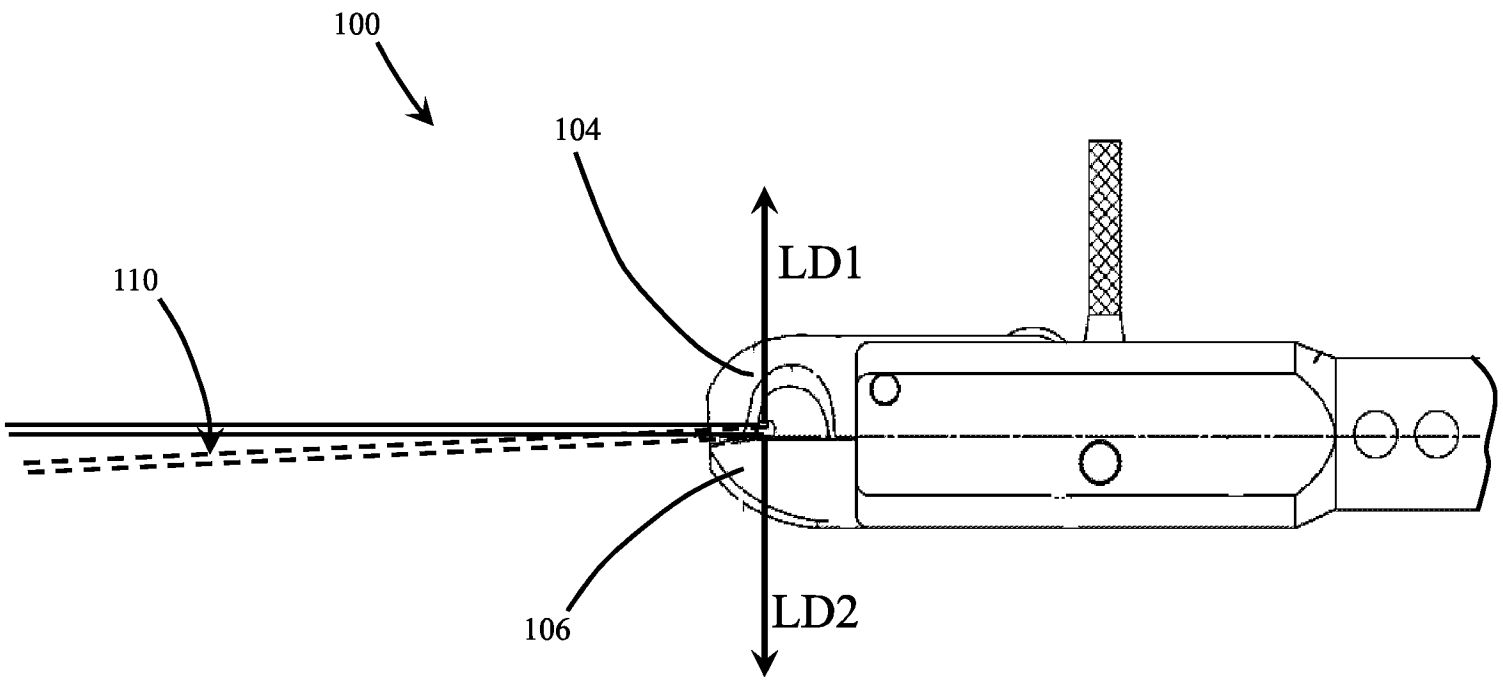
FIG. 1b (PRIOR ART)
FIG. 1*b* is an enlarged view of the prior art release mechanism of FIG. 1*a*, including a single jaw opposing a static or fixed cinch to retain and release the drawstring of an archery bow.
Figure 2:
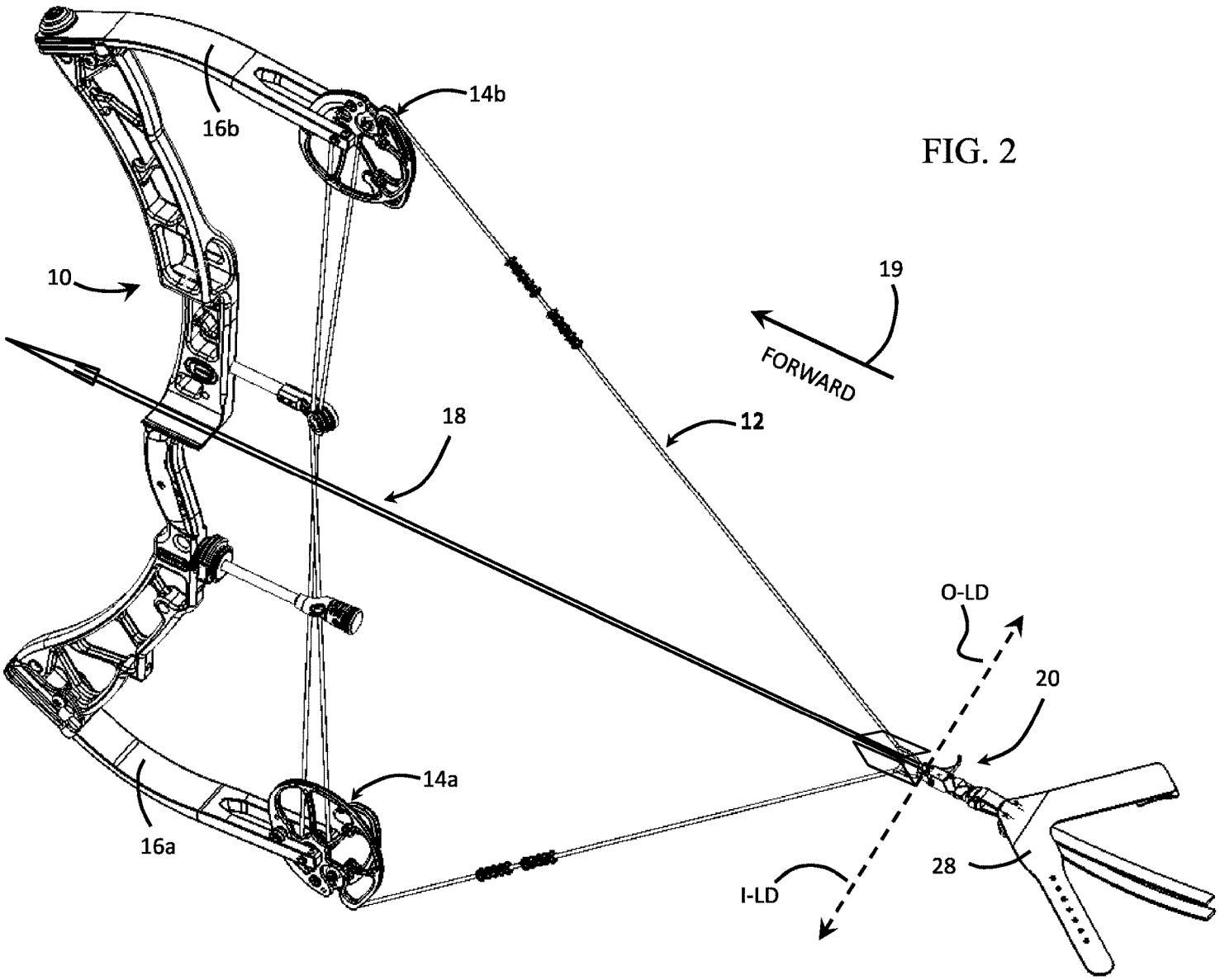
FIG. 2 is a perspective view of an embodiment of an archery release device coupled to a bowstring and bow.
Figure 3:
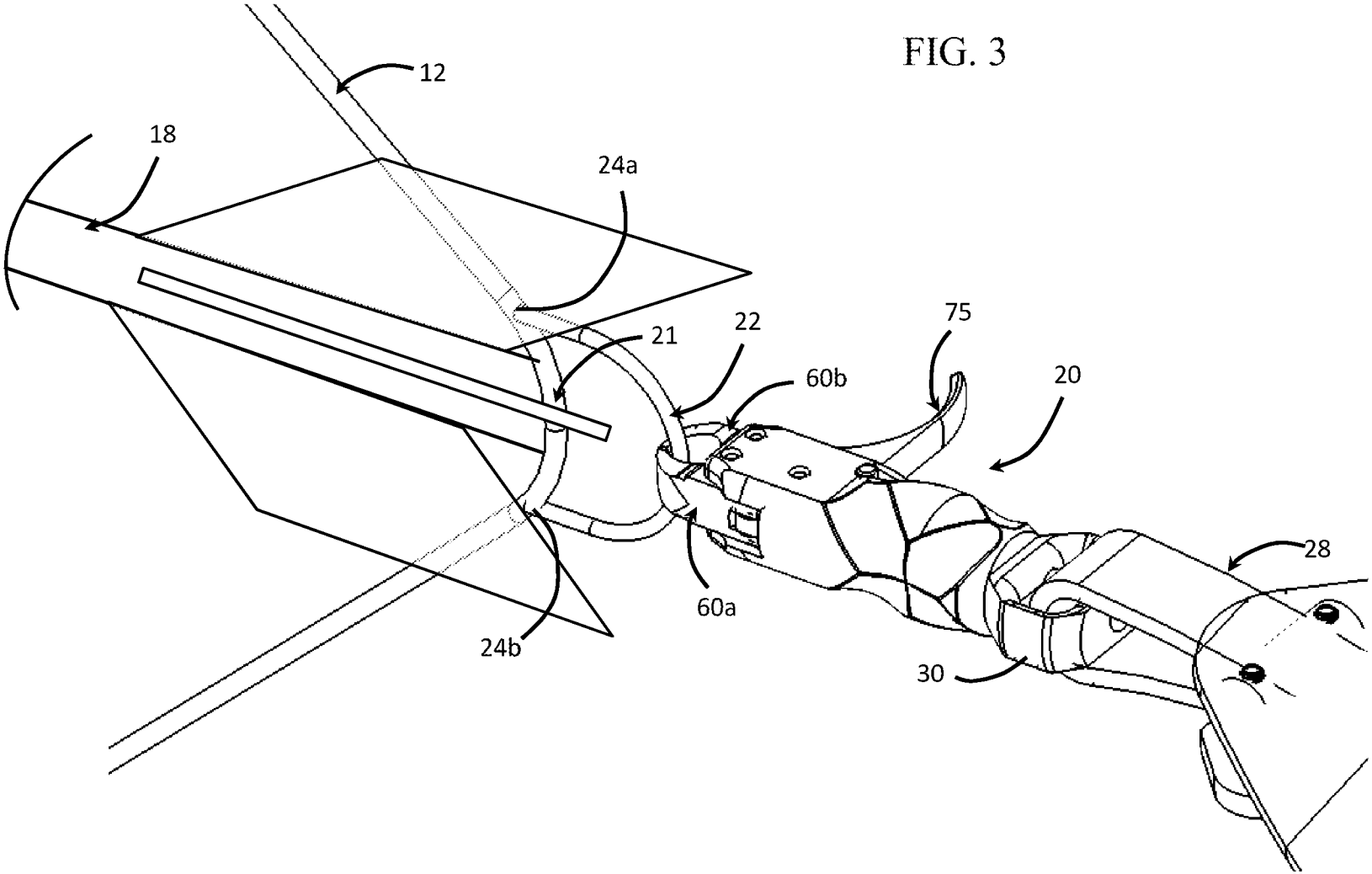
FIG. 3 is a rearward perspective view of the archery release device of FIG. 2, including a pair of first and second jaws and a trigger mechanism for independently holding and releasing the first and second jaws.

FIG. 2 depicts a perspective view of a compound bow 10 having a draw string or bow string 12 drawn through upper and lower cams 14*a*, 14*b* mounted at the end of each bow limb 16*a*, 16*b*. While an embodiment of the archery release device 20 is shown in the context of a compound bow 10, it will be appreciated that the device 20 may be used to assist targeting of any basic, recurved, compound or longbow, or any other type of string-based shooting device. In the illustrated embodiment, an archery release device 20 engages a secondary recurved loop string 22 connecting to the primary bow string 12 at two positions 24*a*, 24*b* (FIG. 3), i.e., one above and the other below the desired location for receiving the arrow 18. While the archery release device 20 is used in combination with a recurved loop string 22, i.e., to preserve the life and integrity of the primary bow string 12, it will be appreciated that the release device may engage the primary bow string directly. The archery release device 20 includes an arm strap, wrist strap or harness 28 for the purpose of supporting the release device 20 while targeting and releasing the bow string 12. In one embodiment, the archery release device 20 includes components/elements which assist in: (i) drawing an arrow 18 against the bow string 12 of an archer's bow, (ii) holding the arrow 18 for a period of time while a target is acquired, and (iii) releasing the arrow 18. Accordingly, in other embodiments (not shown), the archery release device may include grippers, claspers, pinchers or jaws which directly engage the arrow 18 and hold it in position. In such embodiment, the archery release device may, or may not, include a strap, belt or cord to secure the archery release device to the operator/archer.

Figure 4:
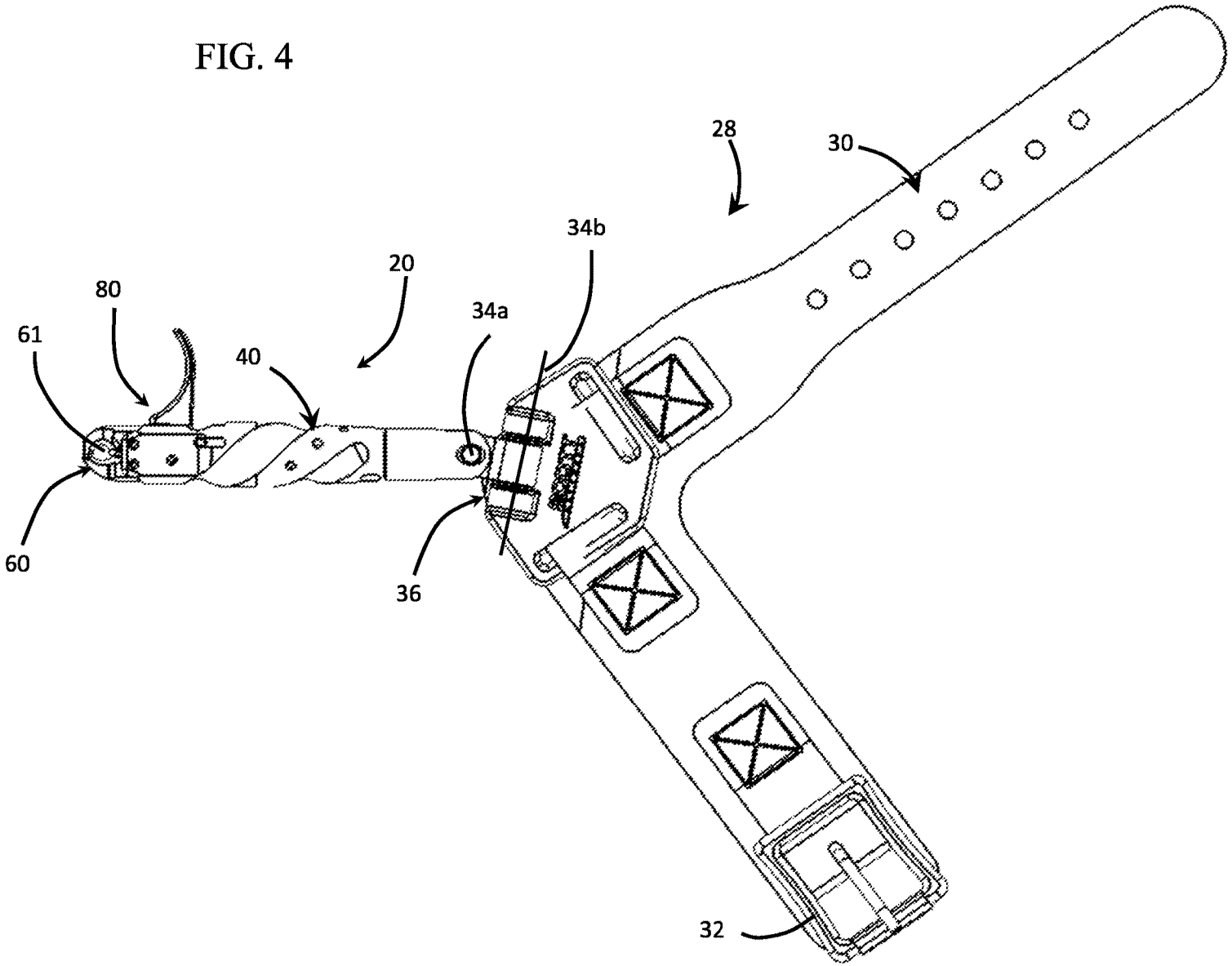
FIG. 4 is a plan view of the archery release device of FIG. 2.
Figure 5:
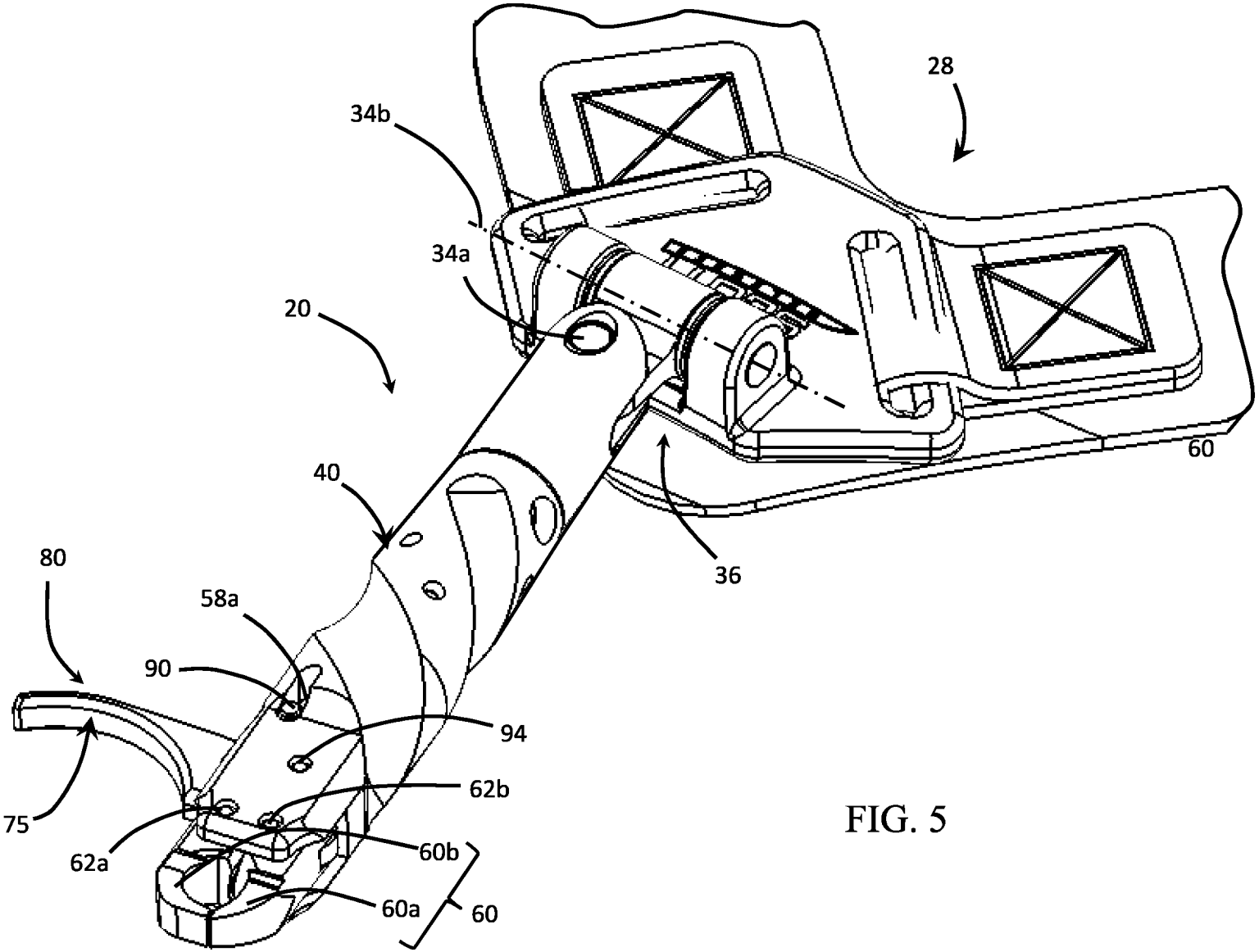
FIG. 5 is an exploded forward perspective of the archery release device shown in FIG. 2.
Figure 8:
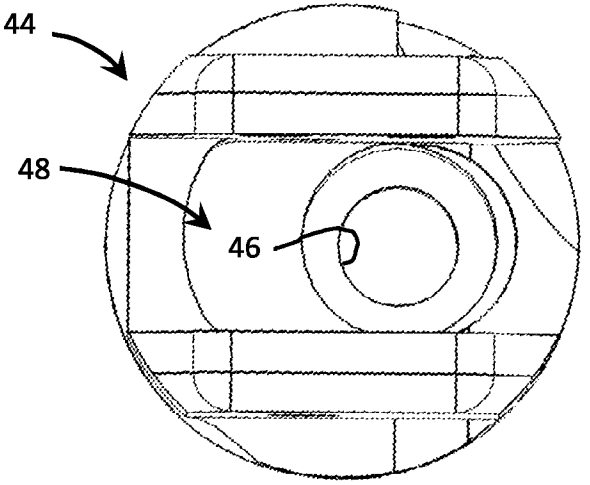
FIG. 8 is a top sectional view of the release body taken substantially along line 8-8 of FIG. 5.
Figure 9:
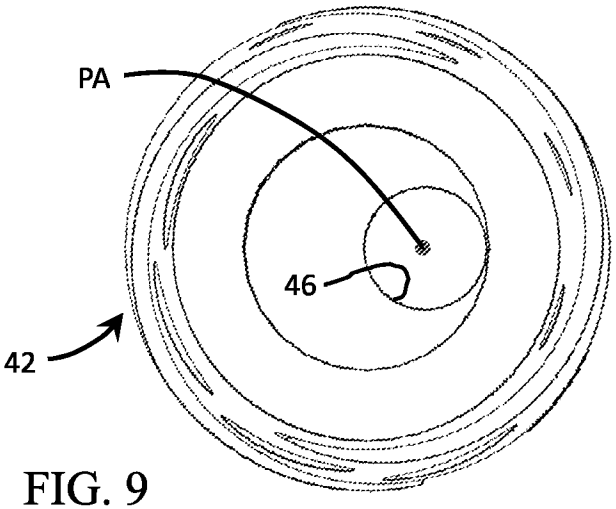
FIG. 9 is a bottom sectional view of the release body taken substantially along line 9-9 of FIG. 5.
Figure 7:
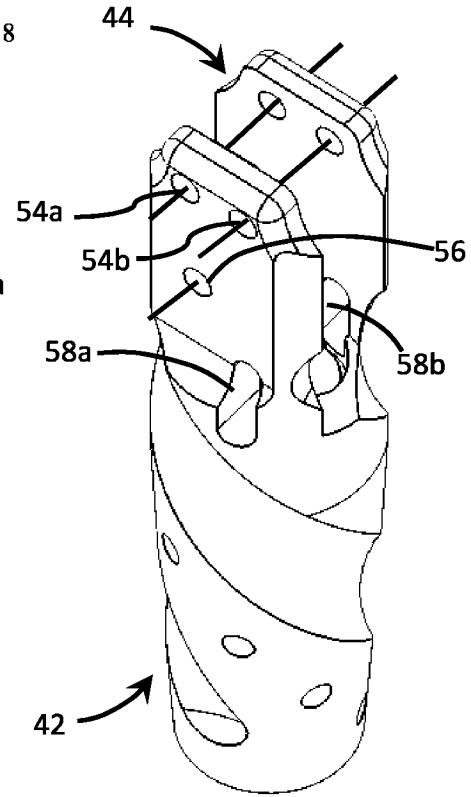
FIG. 7 is a perspective view of the release body of the archery release device of FIG. 5.
Figure 6:
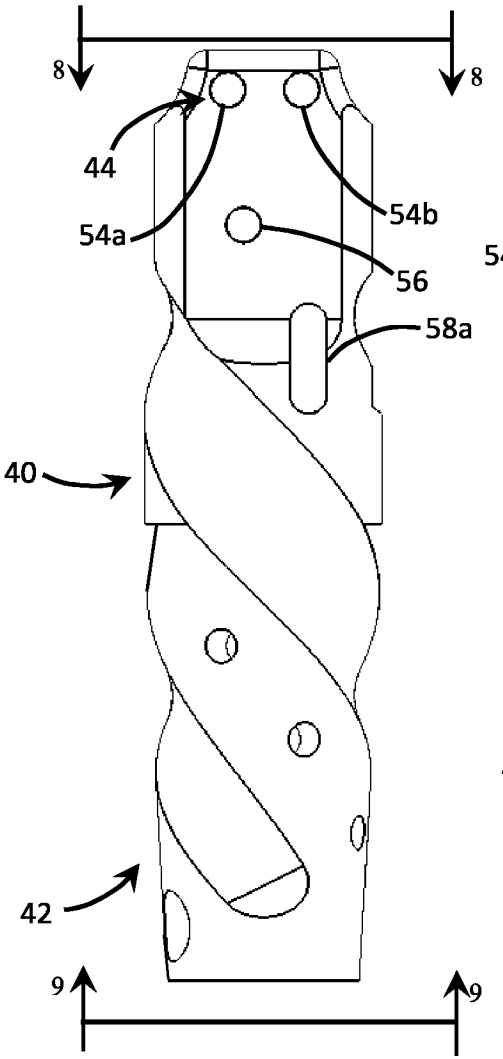
FIG. 6 is a profile view of the release body or housing of the archery release device of FIG. 5.
Figure 10:
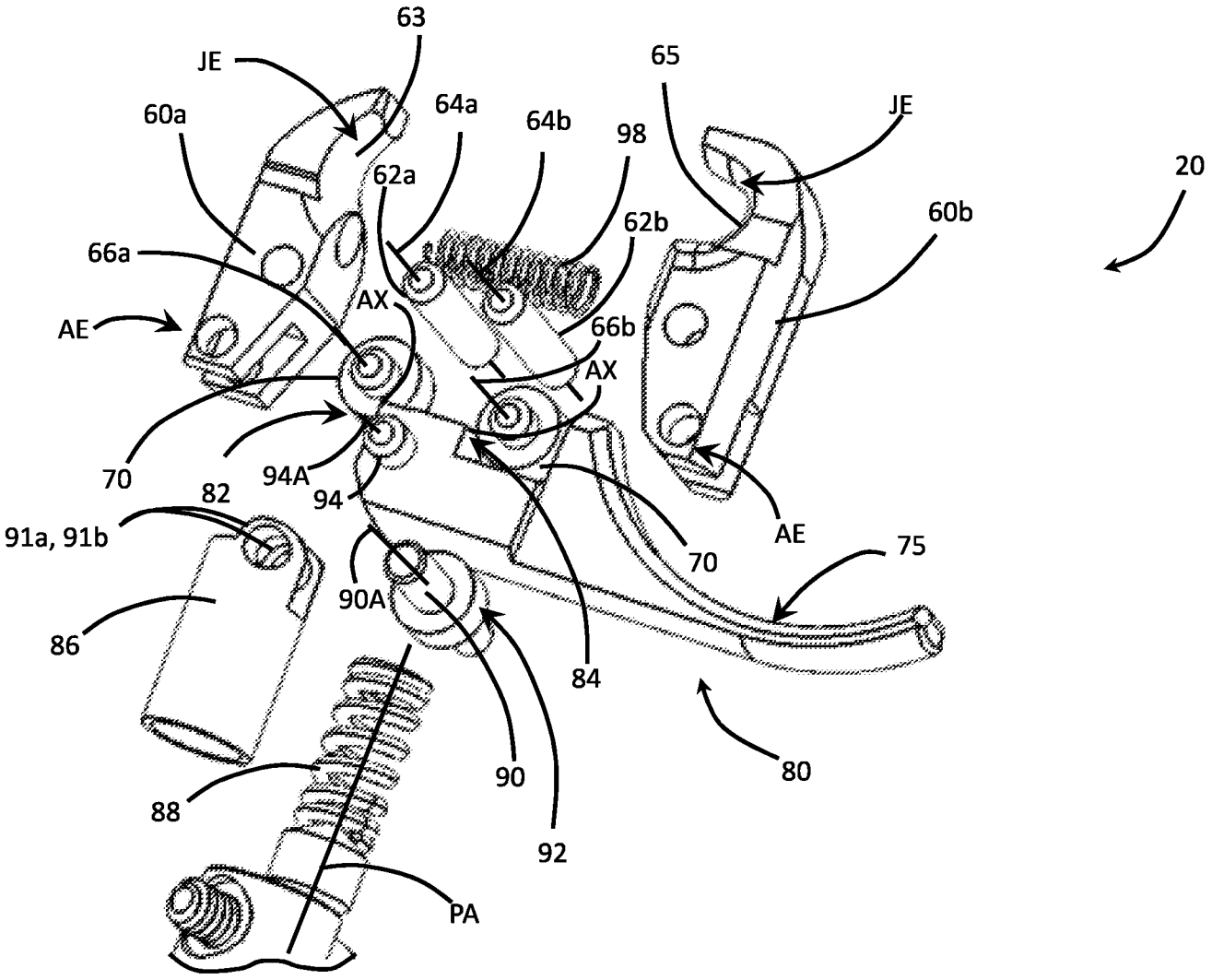
FIG. 10 is an exploded perspective view of the relevant internal components of the archery release device of FIG. 5 which are supported by the release body.

In FIG. 4, the harness 28 of the archery release device 20 is formed by a right-angled, V-shape wrist strap or belt 30 which is fed through, and secured to, a conventional wrist or belt buckle 32. The harness 28 is configured to fit around the wrist or forearm of the operator/archer. In the described embodiment, an aft end of the archery release device 20 is pivotally or articulately mounted to the harness 28 about axes 34*a*, 34*b* to facilitate motion about at least two orthogonal axes. That is, the connection between the harness 28 and the aft end of the release device 20 may include a pair of hinge-mounts, i.e., rotationally mounting about each of the pivot axes 34*a*, 34*b*, or a spherical ball and socket mounting arrangement.

In FIGS. 5 through 10, the archery release device 20 includes a release body 40, a jaw assembly 60 and a trigger 80. The release body 40, best shown in FIGS. 6 through FIG. 9, has a substantially cylindrical/tubular shape at a first end 42 which transitions to a clevis at an opposite or second end 44 thereof. A cylindrical bore 46 is formed, or machined, through the first end 42 which opens into a cavity 48 formed in the second end portion 44 of the release body 40. As will be discussed in greater detail hereinafter, the cylindrical bore 46 is configured to guide the linear travel of a tubular shaped member such as a shaft, cylinder, tube or piston (see FIG. 10) which controls the position of the trigger 80, i.e., changing the position of the first and second jaws 60*a*, 60*b* from a closed position or condition (i.e., pre-release or ready position) to an open position or condition (i.e., a release or actuation position.)

Figure 11:
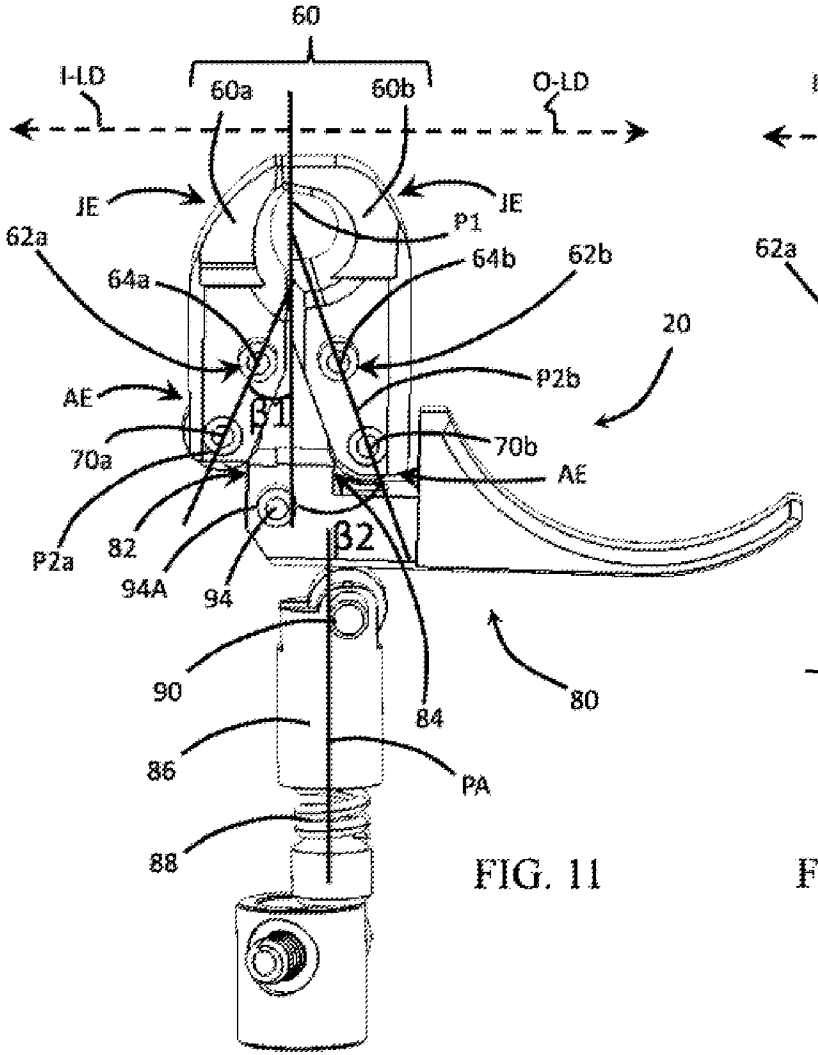
FIG. 11 is a profile view of the internal components of the archery release device of FIG. 5 showing the trigger in a ready or closed position to hold a drawstring between the first and second jaws.

The clevis end 44 of the release body 40 includes first aligned apertures 54*a*, 54*b* configured to receive first and second jaw supports or pins 62*a*, 62*b* (see FIG. 10) for pivotally mounting the jaw assembly 60 to the release body 40. While the cylindrical bore 46, disposed at one end of the release body 40, guides a spring-biased piston 86, the cavity 48 receives: (i) an actuation end AE of the jaw assembly 60, and (ii) the trigger 80 for actuating the jaw assembly 60, at the other end. Finally, the release body 40 includes a pair of guide surfaces or aligned slots 58*a*, 58*b* which extends through a side wall, or the clevis end, of the release body 40. The aligned slots 58*a*, 58*b* receive an axle 90 (see FIG. 10) extending through a pair of clevis lugs 91*a*, 91*b* on each side of the piston 86. The axle 90 also retains a center roller bearing or sear 92 between the lugs 91*a*, 91*b* of the piston 86. The sear 92 engages a surface of the trigger 80 and functions to bias the trigger 80 into a closed or ready position. In this embodiment, the lease body 40 guides the first compression spring 88 along at least one of the guide surfaces 58*a*, 58*b* which is substantially linear to the axis 90. The first compression spring 88 is biased along this axis 90 and is configured to prevent the introduction of a bending moment into the first compression spring 88 upon actuation of the first and second jaws 60*a*, 60*b*. These features and components will become clear when describing the internal components of the archery release device 20 shown in FIGS. 11 and 12.

Figure 12:
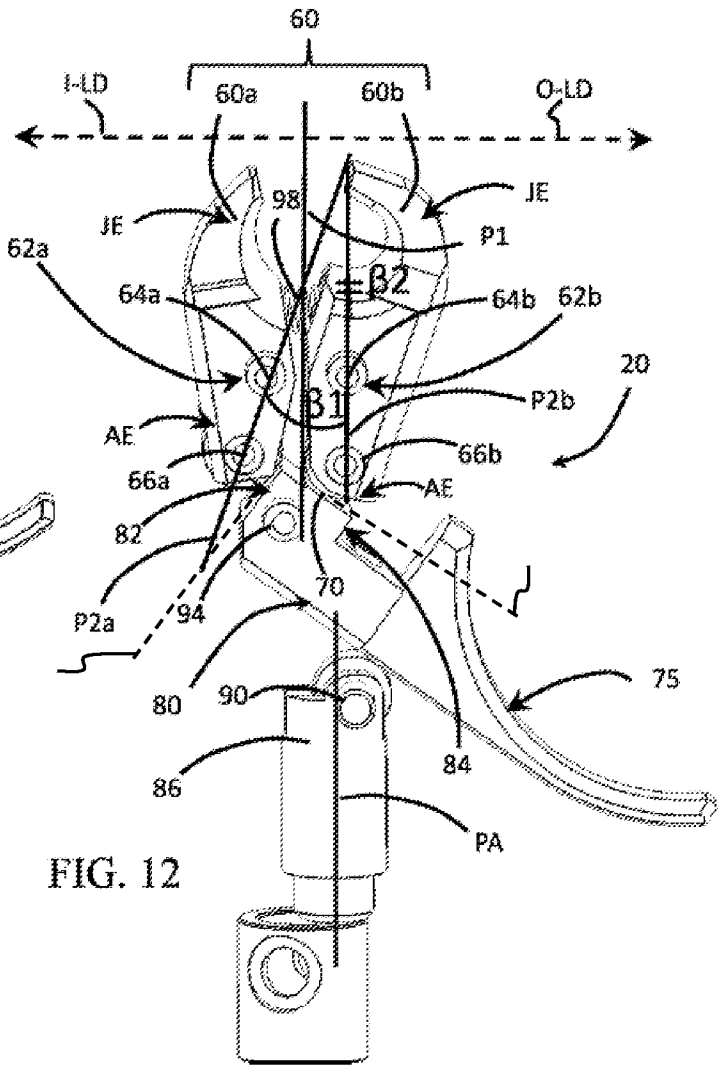
FIG. 12 is a profile view of the internal components of the archery release device of FIG. 5 showing the trigger in an actuated or open position to release the drawstring from the first and second jaws.

The first and second jaws 60*a*, 60*b* of the jaw assembly 60 each include a jaw end portion JE opposite the respective actuation end portion AE. Each of the jaws 60*a*, 60*b* pivots independently of each other about a jaw support. In the described embodiment, the jaw support for one of the jaws 60*a*, 60*b* includes a first pin 62*a* and the jaw support for the other of the jaws 60*a*, 60*b* comprises a second pin 62*b*. Furthermore, the first and second jaws 60*a*, 60*b* are positionable/changeable from the closed position (FIG. 11) to the open position (FIG. 12). In the described embodiment, the first and second jaws 60*a*, 60*b* are spring-biased to the open position by a second compression spring 98. In the described embodiment, the second compression spring 98 seats within a cavity of the jaws or is held between the jaws 60*a*, 60*b* by a transverse pin projecting into the coil opening of the compression spring 98. In another embodiment, the first and second jaws 60*a*, 60*b* may be torsionally-biased about their respective axes 64*a*, 64*b* to remain in the open position. Alternatively, the first and second jaws 60*a*, 60*b* may open without the assistance of a coil or torsion spring, but may open solely in response to motion of a trigger mechanism.

The jaw end portion JE of each of the first and second jaws 60*a*, 60*b* is configured to move in a lateral direction in response to forces imposed by a drawstring portion of the bow. More specifically, jaw 60*a* is configured to move in an inward lateral direction I-LD (see FIGS. 2, 11 and 12) in response to an inward lateral force conveyed by the drawstring 12 of the archery bow 10, caused by a sudden outward lateral motion of the archer's arm (not shown). On the other hand, jaw 60*b* is configured to move in an outward lateral direction O-LD in response to an outward lateral force conveyed by the drawstring 12 of the archery bow 10, caused by a sudden inward lateral motion of the archer's arm. It should be appreciated that the drawstring portion of the bow may include the bow string 12 or a loop 22 (see FIG. 3) connecting at two points to the bow string 12. It should also be appreciated that jaws of different size or geometry will respond differently to these lateral motions, which may differ in rate and magnitude.

The actuation end AE of each of the first and second jaws 60*a*, 60*b* engages one or more over-center release or actuation steps 82, 84 formed in the trigger 80. Each of the actuation ends AE includes an interface portion, roller bearing or sear 70, operative to engage a respective surface or actuation step 82, 84 of the trigger device 80, wherein the surfaces 82, 84 extend along different axes 83, 85, respectively. It will be understood that the actuation steps 82, 84 function to allow independent operation or movement of the respective first and second jaws 60*a*, 60*b*, and, consequently, independent release of the drawstring 12 from the jaws 60*a*, 60*b*. The actuation steps 82, 84 trigger the release device 10, i.e., to release the loop string 22 of the bow 10. In addition to triggering the release of the bow string 12, the actuation steps 82, 84 function in an actuation capacity wherein the apex AX of the respective actuation steps 82, 84, bias the trigger 80 in a clockwise or counter-clockwise direction about a pivot axis 94A of a pin support 94. That is, once a sear 70 rolls over the apex AX of one of the actuation steps 82, 84, the trigger 80 is biased in one rotational position or in the opposite rotational position about the pivot axis 94A.

The trigger 80 rotationally mounts to the release body 40 about the pin support 94 which pivots within the second aligned aperture 56 of the release body 40. The trigger 80 defines the actuation steps 82, 84 which are disposed between the actuation ends 62*a*, 62*b* of the first and second jaws 60*a*, 60*b*. In the described embodiment, the rollers or sears 70 of each of the actuation ends 62*a*, 62*b* function to engage, roll-up and over the actuation steps 82, 84 of the trigger 80. While the illustrated embodiment shows two (2) actuation steps 82, 84, it should be appreciated that only one release step 82, 84 may be employed. It should also be appreciated that jaws 60*a*, 60*b* may be of a different size, e.g., the lengths between a pivot axis 64*a*, 64*b* and the respective sear axis 70*a*, 70*b* may differ to actuate at different rates.

The trigger 80 is biased in a counter-clockwise direction about its pivot axis 94 by a first linearly-guided compression spring 88. More specifically, the first compression spring 88 engages the piston 86 which is guided within the linear bore 46 (see FIG. 8) formed in the release body 40 of the release device 20. The piston 86 is, in turn, guided by, and within, the aligned linear slots 58*a*, 58*b* machined within the side walls or clevis end of the release body 40. With respect to the latter, the axle 92 extends through and projects outwardly from the clevis lugs 91*a*, 91*b* of the piston 86 to engage the linear guide slots 58*a*, 58*b*. The linear slots 58*a*, 58*b* also function to rotationally fix the vertical axis VA of the piston 86. Accordingly, the first compression spring 88 is not subject to bending moment loads which would, otherwise, reduce the service life of the trigger 80.

While the described embodiment depicts a piston 86 configured to receive and retain a roller sear 90 at one end which is guided within linear guide slots 58*a*, 58*b* of the release body 40, it will be appreciated that other arrangements are contemplated. For example, the piston 86 may be guided within a keyway formed within linear bore 46 of the release body 40. Furthermore, while the piston 86 is shown to include a cavity for receiving one end of the first compression spring 88, it will be appreciated that the compression spring 88 may circumscribe a shaft (not shown) which functionally replaces the piston 86 within the bore 46 of the release body 40. Accordingly, the upper end of the shaft would necessarily transition to form a T-shaped cross-member for engaging the guide slots 58*a*, 58*b*. Alternatively, the shaft may comprise telescoping members which are internally biased by a compression spring. A first end of the telescoping shafts may articulately mount to the underside of the trigger 75 while the opposite end may articulately mount internally to a base portion of the release body 40.

Geometrically, the first and second jaws 60*a*, 60*b* are asymmetric about a plane P1 located between the pivot axes 64*a*, 64*b* of the jaws 60*a*, 60*b*. This may be achieved by varying the length or angle of the actuation arm 70 relative to the trigger release-step 84. For example, in the closed position, and referring to FIG. 11, the angles β1 and β2 between the bifurcating plane P1 and the actuation end 70 of the respective one of the jaws 60*a*, 60*b* are unequal or different. That is, the angle β1 between the bifurcating plane P1 and the actuation plane P2*a*, i.e., a plane containing the pivot axis 64*a* and the sear axis 70*a* associated with the first jaw 60*a*, is about twenty degrees (20°). On the other hand, the angle β2 between the bifurcating plane P1 and the actuation plane P2*b*, i.e., a plane containing the pivot axis 64*b* and the sear axis 70*b*, is about fifteen degrees (15°). Accordingly, in the closed position, the angular difference, therebetween is about five degrees (5°).

In the open position, and referring to FIG. 12, the angles β1 and β2 between the bifurcating plane P1 and the actuation end 70 of the respective one of the jaws 60*a*, 60*b*, are also unequal or different. Immediately following release, the angle β1 associated with the first jaw 60*a* is about twelve degrees (12°) and the angle β2 associated with the second jaw 60*b* is about zero degrees (0°). Accordingly, in the open position, the angular difference, therebetween is about twelve degrees (12°).

Figure 13:
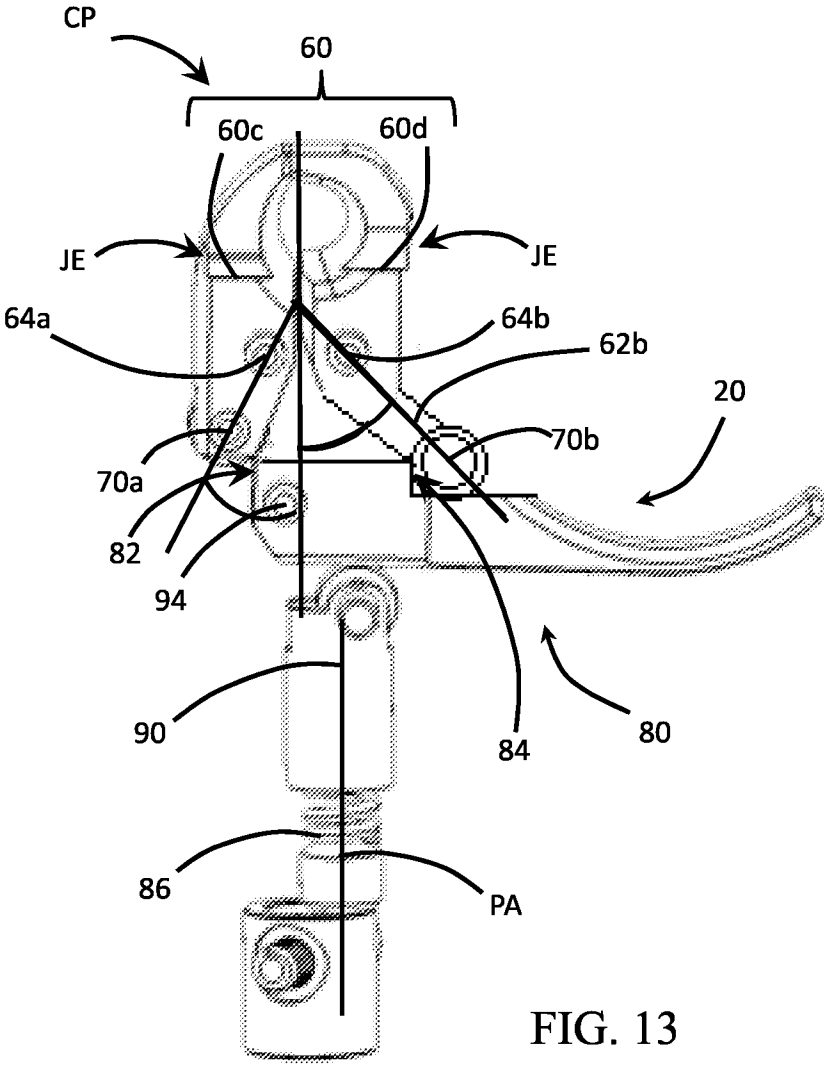
FIG. 13 depicts another embodiment of the archery release device illustrating the asymmetric geometry of the actuation ends of the release mechanism wherein one of the jaws bends outwardly to allow the jaws to open wider upon release.

Asymmetry may also be achieved by employing jaws 60*a*, 60*b* of different size and shape. For example, in FIG. 13, the jaws 60*c*, 60*d* may be configured such that the length between a pivot axis 64*a*, 64*b* and the respective sear axis 70*a*, 70*b* differs to effect a different rate of actuation. More specifically, in FIG. 13, the release-step 84 of the trigger 80 is distally spaced from the pivot axis 94 of the trigger 80. Furthermore, the actuation end AE of jaw 60*d* curves or bends outwardly such that when the sear rolls up and over the release step 84, the jaw 60*d* opens wider and, depending upon the spring rate of the biasing coil spring (not shown), and spreads more rapidly.

Figure 14:
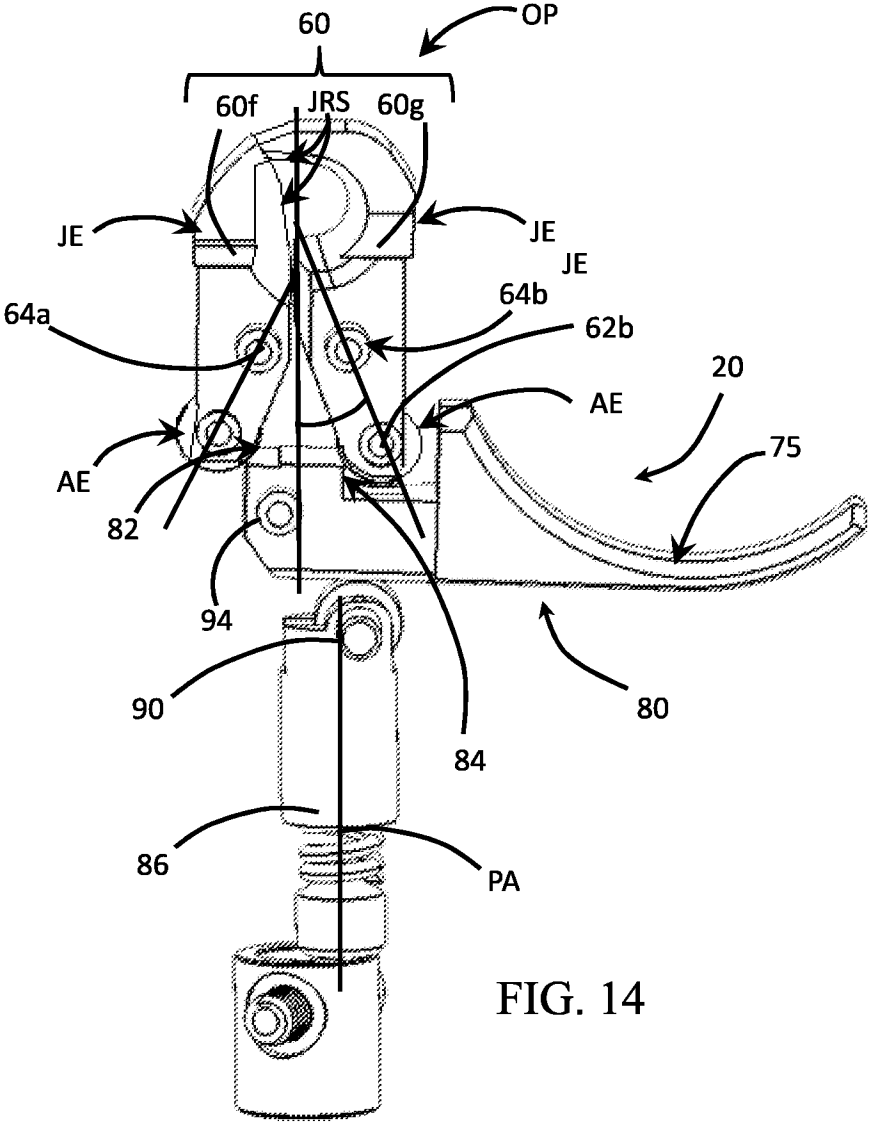
FIG. 14 depicts another embodiment of the archery release device illustrating the asymmetric geometry of the jaw ends of the release mechanism wherein the release surfaces are contoured to affect a smooth, controlled release of the drawstring loop.

In FIG. 14, the shape of the jaws 60*f*, 60*g* may be asymmetric to affect the placement of the drawstring release loop 22 within the jaws 60. For example, the jaw release surface JRS of the first jaw 60*f* may curve outwardly while the release surface JRS of the second jaw 60*g* may slope slightly away from the pivot axis 64*b* to facilitate a smooth release of the drawstring.

In operation, the trigger 80 is actuated by engaging the release arm 75, i.e., by rotating the arm 75 in a clockwise direction against the linear force of the first compression spring 88. The trigger device 80 causes the actuation ends 62*a*, 62*b* of each of the respective first and second jaws 60*a*, 60*b* to engage the corresponding one of the actuation steps 82, 84, formed on the trigger device 80. Actuation of the trigger device 80: (i) opens/releases the drawstring 12 of the archery bow 10, and (ii) releases the jaw assembly 60 such that the first and second jaws 60*a*, 60*b* may pivot independently and/or freely. That is, each of the first and second jaws

60*a*, 60*b* may be displaced independently, in a lateral direction, in response to a lateral force applied or imposed by the drawstring portion of the archery bow.

More specifically, the first and second jaws 60*a*, 60*b* are initially engaged with each other to hold a drawstring portion of the bow in the closed position. The jaws 60*a*, 60*b* are at least partially disengaged from each other to release the drawstring portion in an open position. The jaws 60*a*, 60*b* are biased closed by the linear compression spring 88 acting on the trigger 80 while the first and second jaws 60*a*, 60*b* are biased against the force of the first compression spring 88 by the second compression spring 98 acting between the first and second jaws 60*a*, 60*b*. The relative strength of the opposing forces imposed by each of the first and second compression springs 88, 98 determines the relative ease or difficulty with which the trigger 80 actuates the release or opening of the first and second jaws 60*a*, 60*b*.

In summary, the jaws 60 of the release mechanism 20 may pivot along the same or different axes, are geometrically asymmetric and are free to pivot independently immediately following release of the trigger mechanism. More specifically of the actuation steps 82, 84 determine how the first and second jaws 60*a*, 60*b* open in response to actuation of the trigger device 80. The linear force produced by the second compression spring 98 acting between the first and second jaws 60*a*, 60*b* determines the force necessary to reset the trigger device 80 and the first and second jaws 60*a*, 60*b* to a closed position. The guided piston 86 prevents moment loads from acting on the first compression spring 88 to improve the dynamic response of the trigger device 80. Finally, upon actuation of the trigger 80, the first and second jaws 60*a*, 60*b* are essentially free to move independently. As such, the drawstring 12 (see FIG. 3) can be released: (i) without resistance from either one of the first and second jaws 60*a*, 60*b*, (ii) without being hung-up on one of the first and second jaws 60*a*, 60*b*, and (iii) without being influenced by the rigidity of one, or the other, of the first and second jaws 60*a*, 60*b*. That is, the actuation steps 82, 84 allow the first and second jaws 60*a*, 60*b* to move independently which, in turn, allows the drawstring 12, or drawstring loop 22, to move past the jaws 60*a*, 60*b* with as little resistance/disturbance as possible. Accordingly, should the archer suddenly and unintentionally jerk or twitch his/her wrist or arm at the moment immediately prior to release, the affected one of the jaws 60*a*, 60*b* will freely pivot independent of the other of the jaws 60, 60*b*. This pivot motion/reaction eliminates or reduces undesirable lateral pulling on the bow string 12, which, in turn, improves shooting performance and flight of an arrow 18 released from an archery bow.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery release device comprising:

a release body configured to be coupled to a harness;

a jaw assembly comprising:

a first jaw support coupled to the release body;

a first jaw pivotally coupled to the first jaw support, the first jaw comprising a first jaw portion;

a second jaw support coupled to the release body; and a second jaw pivotally coupled to the second jaw support, the second jaw comprising a second jaw portion, wherein:

the first and second jaws are changeable from a closed position to an open position;

in the closed position, the first and second jaws are engaged with each other to hold a drawstring portion; and in the open position, the first and second jaw portions are at least partially disengaged from each other to release the drawstring portion; and a trigger configured to enable the first and second jaws to change from the closed position to the open position, and comprising at least one actuation portion pivotally coupled to the release body, wherein the actuation portion comprises a first surface extending along a first axis and a second surface extending along different axis a second axis that is different than the first axis, wherein the first axis and the second axis extend along intersecting planes, and wherein the actuation portion is configured to pivot relative to the release body in response to a force applied to the trigger, wherein a first positioning of the first jaw portion relative to the first surface is variable while a second positioning of the second jaw portion relative to the second surface is variable;

wherein, in the open position, the first and second jaws are configured to pivot independent of each other;

the first jaw is configured to move in an inward lateral direction in response to an inward lateral force conveyed by the drawstring portion; and the second jaw is configured to move in an outward lateral direction in response to an outward lateral force conveyed by the drawstring portion.

2. The archery release device of claim 1, wherein:

the first jaw comprises a first roller engaged with the first surface; and the second jaw comprises a second roller engaged with the second surface.

3. The archery release device of claim 1, comprising the harness, wherein:

the harness is coupled to the release body; and the harness is configured to secure the release body to a portion of an arm of a user.

4. An archery release device comprising:

a release body;

first and second jaws pivotally mounted to the release body about respective pivot axes, the first and second jaws being configured to: (i) pivot toward each other while changing to a closed position to retain a drawstring of an archery bow, and (ii) pivot away from each other while changing to an open position to release the drawstring of the archery bow; and a trigger pivotally mounted to the release body and having:

a first surface configured to moveably engage a first actuation end of the first jaw; and a second surface configured to moveably engage a second actuation end of the second jaw, wherein the first and second surfaces extend along different axes, wherein the first and second surfaces are configured to pivot relative to the release body, wherein the trigger is configured to facilitate independent motion of at least one of the first and second jaws in response to a lateral force applied by the drawstring.

5. The archery release device of claim 4, wherein the first and second jaws are asymmetric relative to a central plane lying between the pivot axes.

6. The archery release device of claim 5, wherein an angle is defined by the central plane and a line intersecting the pivot axis and a sear axis of each of the first and second jaws, and wherein the angle defined by the first jaw is different than the angle defined by the second jaw.

7. The archery release device of claim 4, wherein:

the trigger is configured to pivot about a trigger pivot axis relative to the release body;

each of the first and second jaws is configured to pivot about a jaw pivot axis relative to the release body;

the trigger comprises at least one actuation portion; and the at least one actuation portion defines an apex causing an over-center condition relative to a line connecting one of the jaw pivot axes to the trigger pivot axis.

8. The archery release device according to claim 4, wherein:

the first and second jaws are biased in a closed position by a first compression spring acting on the trigger; and the first and second jaws are biased in an open position by a second compression spring acting between the first and second jaws.

9. The archery release device of claim 8, wherein each of the first and second jaw defines a first contour associated with a first drawstring release surface and the second jaw defines a second contour associated with a second drawstring release surface, and wherein the first contour of the first drawstring release surface is different than the second contour of the second drawstring release surface.

10. The archery release device of claim 8, wherein the release body defines a guide surface configured to guide the first compression spring along an axis and wherein the guide surface is configured to prevent an introduction of a bending moment into the first compression spring upon actuation of the first and second jaws.

11. The archery release device of claim 10, wherein the guide surface includes a pair of guide slots formed through a side wall of the release body, wherein the release body includes a bore for receiving a piston configured to retain a roller sear at one end thereof for engaging a surface of the trigger, and wherein the roller sear includes an axle having ends which engage and are guided by the guide slots of the release body.

12. The archery release device of claim 10, wherein the guide surface includes a pair of guide slots formed through a side wall of the release body, the guide slots configured to guide a roller sear biased against the trigger by the first compression spring.

13. The archery release device of claim 8, wherein the second compression spring produces a spring bias force which opposes a first spring bias force produced by the first compression spring.

14. An archery release device comprising:

a release body configured to be coupled to a harness;

a first jaw pivotally coupled to the release body, the first jaw comprising a first jaw portion and a first interface portion;

a second jaw pivotally coupled to the release body, the second jaw comprising a second jaw portion and a second interface portion; and a trigger operatively coupled to the first and second jaws, wherein the trigger comprises a first surface engaged with the first interface portion, wherein the trigger comprises a second surface engaged with the second interface portion, wherein the first and second surfaces extend along different axes, wherein the first and second surfaces are configured to pivot relative to the release body, wherein the first and second jaws are configured to pivot independent of each other, wherein, in response to an inward lateral force applied to the first jaw, the first jaw portion is configured to move relative to the trigger in an inward lateral direction, wherein, in response to an outward lateral force applied to the second jaw, the second jaw portion is configured to move relative to the trigger in an outward lateral direction.

15. The archery release device of claim 14, wherein:

the first and second jaws are configured to transition from a closed position to an open position;

in the closed position, the first and second jaws are engaged with each other to hold a drawstring portion; and in the open position, the first and second jaw portions are at least partially disengaged from each other to release the drawstring portion.

16. The archery release device of claim 15, wherein:

the first interface portion is configured to comprise a first movement relative to the first surface;

the second interface portion is configured to comprise a second movement relative to the second surface; and the first movement is independent of the second movement.

17. The archery release device of claim 16, wherein, in the open position, the first and second jaws are configured to pivot independent of each other.

18. The archery release device of claim 16, wherein, in response to the inward lateral force applied to the first jaw in the open position, the first jaw is configured to move relative to the second jaw in the inward lateral direction.

19. The archery release device of claim 18, wherein, in response to the outward lateral force applied to the second jaw in the open position, the second jaw is configured to move relative to the first jaw in the outward lateral direction.

20. The archery release device of claim 16, wherein:

the first interface portion comprise a comprises a first roller;

the second interface portion comprise a comprises a second roller;

the first surface of the trigger is configured to be moveably engaged with the first roller; and the second surface of the trigger is configured to be moveably engaged with the second roller.

21. The archery release device of claim 15, wherein:

the trigger comprises at least one actuation step;

the at least one actuation step at least partially defines a space; and in the closed position, at least one of the first and second interface portions is engaged with the at least one actuation step and positioned at least partially within the space.

22. The archery release device of claim 21, wherein during a transition from the open position to the closed position, the first surface of the trigger remains engaged with the first interface portion of the first jaw, and the second surface of the trigger remains engaged with the second interface portion of the second jaw.

* * * * *